US010336578B2

(12) United States Patent
Legua

(10) Patent No.: US 10,336,578 B2
(45) Date of Patent: Jul. 2, 2019

(54) ELEVATOR SYSTEMS

(71) Applicant: AIP APS, Hillerød (DK)

(72) Inventor: Carlos Legua, Saragossa (ES)

(73) Assignee: AIP APS, Hillerød (DK)

( * ) Notice: Subject to any disclaimer, the term of this patent is extended or adjusted under 35 U.S.C. 154(b) by 0 days.

(21) Appl. No.: 15/128,995

(22) PCT Filed: Mar. 20, 2015

(86) PCT No.: PCT/EP2015/055974
§ 371 (c)(1),
(2) Date: Sep. 26, 2016

(87) PCT Pub. No.: WO2015/144593
PCT Pub. Date: Oct. 1, 2015

(65) Prior Publication Data
US 2017/0113901 A1 Apr. 27, 2017

(30) Foreign Application Priority Data
Mar. 26, 2014 (EP) ..... 14382104

(51) Int. Cl.
*B66B 5/28* (2006.01)
*B66B 7/06* (2006.01)
*B66B 9/187* (2006.01)

(52) U.S. Cl.
CPC ..... *B66B 7/06* (2013.01); *B66B 5/284* (2013.01); *B66B 9/187* (2013.01)

(58) Field of Classification Search
CPC ..... B66B 5/28; B66B 5/282; B66B 5/284; B66B 5/286; B66B 7/06; B66B 11/02; B66B 11/0206
See application file for complete search history.

(56) References Cited

U.S. PATENT DOCUMENTS 249,076 A * 11/1881 Moulton ..... B66B 5/282 187/343
623,079 A * 4/1899 Ellingwood ..... B64C 25/60 188/297

(Continued)

FOREIGN PATENT DOCUMENTS

CN 202272600 U 6/2012
DE 10 2011 100 770 A1 3/2012

(Continued)

OTHER PUBLICATIONS

Prof. Pott, LL.M., Notice of Opposition dated Feb. 8, 2019, EP Patent No. EP 2923988 B1, 15 pages (including English translation).

(Continued)

*Primary Examiner* — Minh Truong
(74) *Attorney, Agent, or Firm* — MH2 Technology Law Group LLP

(57) ABSTRACT

An elevator system comprising an elevator cabin, and a traction wire rope for driving the elevator cabin and/or a safety wire rope, wherein the elevator system further comprises an upper transverse element provided above the elevator cabin and adapted to be guided along the traction wire rope and/or the safety wire rope, and a support structure which is adapted to support the upper transverse element and substantially impede its movement in a downwards direction and in a horizontal direction, and to allow movement of the upper transverse element in an upwards direction.

12 Claims, 8 Drawing Sheets

(56) References Cited

U.S. PATENT DOCUMENTS

| | | | | | |
|---|---|---|---|---|---|
| 1,386,253 | A * | 8/1921 | Heyl | B66B 5/282 187/347 |
| 3,666,051 | A * | 5/1972 | Davis | B66B 7/06 187/239 |
| 3,866,718 | A | 2/1975 | Hiergeist | |
| 4,072,213 | A * | 2/1978 | Salmon | B66B 7/06 187/266 |
| 4,117,908 | A * | 10/1978 | Nara | B66B 7/06 187/254 |
| 5,427,327 | A | 6/1995 | Anderson et al. | |
| 6,047,792 | A * | 4/2000 | Jin | B66B 11/0206 187/401 |
| 8,047,335 | B2 * | 11/2011 | Fargo | B66B 7/10 187/411 |
| 10,099,895 | B2 * | 10/2018 | Miseur | B66B 7/06 |
| 2011/0248506 | A1 | 10/2011 | Ruiz Urien et al. | |
| 2011/0266096 | A1 * | 11/2011 | Nies | B66B 9/16 187/251 |
| 2017/0369281 | A1 * | 12/2017 | Miseur | B66B 7/06 |
| 2018/0327226 | A1 * | 11/2018 | Miyajima | B66B 7/06 |

FOREIGN PATENT DOCUMENTS

| | | | |
|---|---|---|---|
| DE | 102011100770 | A1 | 3/2012 |
| EP | 2457863 | A1 | 5/2012 |
| JP | 11209031 | A * | 8/1999 |
| JP | 2007284222 | A * | 11/2007 |
| JP | 2009-18899 | A | 1/2009 |
| WO | 2012/052583 | A1 | 4/2012 |

OTHER PUBLICATIONS

Carpmaels & Ransford, Statement of Grounds of Opposition, EP Patent No. EP 2923988, pp. 1-16.

Avanti Wind Systems, Avanti Wind Systems in service agreement for 500 turbine tow, Renewable Energy Magazine, Jan. 30, 2019, pp. 1-2.

American Society of Mechanical Engineers, Part 5 Special Application Elevators, ASME A17.1-2013/CSAB44-13, pp. 169 and 216.

Kathie Zipp, "Long overdue: A national standard for wind tower service lifts", Mar. 5, 2012, https://www.windpowerengineering/.com/operations-maintenance/safety/long-overdue-a-national-standard-for-wind-tower-service-lifts/, accessed Feb. 7, 2019, pp. 1-8.

Wayne Wallace, "Retightening Wind Turbine Flange Splice Bolts Inherent Problems with Installation and Retightening Using Torque Values", reprinted from Distributor's Link Magazine, 2009, pp. 1-3.

European Search Report dated Dec. 12, 2013, EP Application No. 13382291.6, pp. 1-5.

Hailo, Hailo Servicelifts, Sep. 2010, pp. 1-14.

American Society of Mechanical Engineers, Safety Code for Elevators and Escalators, Oct. 21, 2013, 2 pages.

Erich Hau, Wind Turbines, Fundamentals, Technologies, Application, Economics, 2nd edition, 3 pages.

Oxford University Press, The Concise Oxford Dictionary, Ninth Edition, 1995, 3 pages.

Power Climber, Installation Manual, Turbine Service Platform, Type: Sherpa-SD1 (Sliding Door—Edition 2) for Hybrid Tower, Jan. 5, 2012, pp. 1-32.

Tüv Cert, EG-Baumusterprüfung, Mar. 27, 2008, Goracon, GW-250-01-LA, 30 pages (no translation provided).

* cited by examiner

ELEVATOR SYSTEMS

CROSS REFERENCE TO RELATED APPLICATIONS

This application is a U.S. National Stage application of PCT/EP2015/055974, filed Mar. 20, 2015, which claims priority to European Application No. 14382104.9, filed Mar. 26, 2014, the contents of all of which are hereby incorporated by reference in their entirety.

The present disclosure relates to elevator systems and wind turbines comprising such elevator systems.

BACKGROUND

Modern wind turbines are commonly used to supply electricity into the electrical grid. Wind turbines generally comprise a rotor with a rotor hub and a plurality of blades. The rotor is set into rotation under the influence of the wind on the blades. The rotation of the rotor shaft drives the generator rotor either directly ("directly driven") or through the use of a gearbox. The operation of the generator produces the electricity to be supplied into the electrical grid.

When maintenance works are required inside wind turbines, hoists are often used in the form of elevator-like structures where a lift platform or a cabin for the transportation of people and/or equipment is hoisted up and/or down within the wind turbine tower. Wind turbines are often provided with working platforms arranged at various heights along the height of the tower with the purpose of allowing workers to leave the cabin and inspect or repair equipment where intended. These sorts of elevator systems are also known in other applications, such as e.g. factories, construction sites, and all sorts of towers.

Elevator systems, in general, include an elevator car being suspended within a hoistway by ropes, cables or belts. In some systems, e.g. some electric elevators, a counterweight may be provided, depending on e.g. the available space. Other systems such as hydraulic elevators normally do not comprise a counterweight. Typically, elevator systems include a moving or travelling cable for supplying electric power to the elevator cabin and/or for signal communication between components associated with the elevator car/cabin and a control panel provided in a fixed location relative to the hoistway.

Elevator systems of the type that are "ladder-guided" or "cable-guided" normally comprise traction and/or safety wire ropes that run free in a direction parallel to the movement of the elevator car.

In use, there may be circumstances in which the traction and/or safety wire ropes may begin to move and sway within an elevator hoistway or the wire ropes can become tangled up in themselves. This is most prominent in high slender structures, such as e.g. tower of larger (MW class) wind turbines, in which the tower may oscillate significantly. In these cases, the traction and/or safety wire ropes can also strike the working platforms, platform fences or tower flanges provided inside the hoistway. Even in some circumstances, e.g. inside a tower of larger wind turbines, the traction and/or safety wire ropes may come in contact with or potentially get entangled with the power cables from the wind turbine generator.

Other circumstances in which the traction and safety wire ropes may come in contact with other components may occur in wind turbine towers in which an elevator path may be curved, e.g. because at the base there is an electronic compartment on one side or because the available space for housing the elevator and e.g. the ladder, requires a change in the orientation of the elevator. Since the traction and safety wire ropes run free, they seek to straighten out. This may result in them striking or interfering with the working platforms, tower flanges or a ladder provided at the hoistway inner surface.

Further circumstances that result in the traction and safety wire ropes touching parts within a tower relate to the shape of the towers. In some cases, a major or minor tapering of the tower is required e.g. due to a change of the material from which the tower is built. For example, a bottom portion of a tower may be made from concrete and an upper portion of the tower may be made from steel. In these situations the distance of the wire ropes to the inner walls of the tower may vary from one section to the other and the orientation of the elevator may need to be changed. Again, as the traction and safety wire ropes seek to straighten out, this may result in the wire ropes striking the working platforms or tower flanges provided on the inner surface of the hoistway.

As mentioned above, in such tall structures, in general, elevator ropes and cables, which may include hoist ropes, compensation ropes, governor ropes, and travelling cables, may vibrate in harmony with the wind induced sway of the structure and other dynamic factors affecting the structure. Particularly in wind turbines, several loads such as for example aerodynamic forces associated with the wind, rotor rotation, etc. may act on the structure. These loads may further be increased in offshore wind turbines by the forces exerted by waves, currents and tides in case of offshore structures.

The aforementioned loads can produce vibrations and sway of the ropes and cables which may cause fatigue and wear, excessive noise, and the increased possibility of tangling thus potentially shortening the lifetime of the ropes and cables and complicating normal operation of the elevator system.

There is thus a need for reliable and effective elevator systems which reduce or eliminate at least some of the afore-mentioned drawbacks.

SUMMARY

According to a first aspect, an elevator system is provided. The elevator system comprises an elevator cabin, and a traction wire rope for driving the elevator cabin and/or a safety wire rope. The elevator system further comprises an upper transverse element provided above the elevator cabin and adapted to be guided along the traction wire rope and/or the safety wire rope, and a support structure, which is adapted to support the upper transverse element and substantially impede its movement in a downwards direction and in a horizontal direction, and to allow movement of the upper transverse element in an upwards direction.

According to this aspect the upper transverse element resting on a support structure provides a spacer for the wires (traction and/or safety wire ropes) with respect to other components such as the ladder, working platforms, tower flanges or even the inner wall of a hoistway. Such a support structure may be provided at some point along the hoistway. Throughout the present description and claims, hoistway is to be understood as the space for the travel of an elevator. Hoistway herein thus covers any open or closed space suitable for the travel of an elevator.

Furthermore, since the support structure provides the upper transverse element with a degree of freedom in the upwards direction while substantially limiting downwards and horizontal movements of the upper transverse element, the support structure allows normal operation of the elevator cabin. This means that the upper transverse element does not impede normal operation of the elevator cabin, or what is the same, the cabin can go up and down throughout the hoistway and the upper transverse element does not hamper its career in any direction. This can be achieved because, in use, when the cabin is going upwards and reaches a position of a support structure, i.e. a position in which an upper transverse element rests, the elevator cabin pushes the upper transverse element from below thus dragging it with the cabin in an upwards movement. And when, the cabin is going downwards and reaches the position of a support structure, the upper transverse element is left supported by the support structure while the elevator cabin continues it downwards path. In this case, especially when the cabin is at a lower position with respect to the support structure, the upper transverse element aids stabilizing the traction and/or security wire ropes even when loads producing vibrations and sway of the wire ropes are acting. Tangling up of the wire ropes in them can also thus be avoided or substantially reduced with the provision of this transverse element. The wire ropes are thus subjected to less stress therefore extending its lifetime.

In summary, a system substantially as hereinbefore described restricts movements of the traction and/or security wire ropes housed inside the hoistway thus avoiding, or at least reducing, the striking of these wires with other components arranged in the hoistway such as working platforms, platform fences, the ladder or even the inner wall of the hoistway. Also, in those cases in which e.g. a distance between the ladder and the wires is not enough to allow safe climbing of users, the upper transverse element can provide the required distance between the ladder and the wires, i.e. it may act as a spacer. An upper transverse element substantially as hereinbefore described further aids reducing entangling of the wires with themselves.

Furthermore, the provision of the upper transverse element substantially as hereinbefore described is relatively simple to implement. It can therefore be easily retrofitted into existing elevator installations having traction and/or security wire ropes. In some examples, the upper transverse element may be built in two or more portions formed such that they are put together around the traction and/or security wire ropes. In these cases, mounting an upper transverse element in existing elevator installations having traction and/or security wire ropes may be done by simply joining together the two or more portions around the traction and/or security wire ropes. Dismantling of the traction and/or security wire ropes could thus even be avoided.

In some examples, the upper transverse element may have a size in at least a direction transverse to elevator cabin up and down movement that is adapted to be larger than that of the elevator cabin in that direction. This way, when the elevator cabin goes downwards the upper transverse element can rest in the support structure that may be provided along the hoistway and the support structure does not interfere with elevator cabin movement. The support structure may be provided anywhere along the elevator path. In alternative examples, the support structure may be foldable or retractable in order to allow movement of the elevator cabin.

In some examples, the elevator cabin may comprise a buffer element arranged on top of the elevator cabin and adapted to contact the upper transverse element. A buffer element provided on top of the elevator cabin ensures a smooth contact of the cabin with the upper transverse element when the cabin is moving upwards. This reduces impacts received by the elevator cabin.

In some examples, the elevator system may further comprise a travelling cable for supplying energy to the elevator cabin and a pulley system movably suspended on the travelling cable. In some of these cases, the pulley system may further be adapted to be guided along the traction and/or security wire ropes and may comprise a lower transverse element having one end attached to the pulley system and the other end adapted to be slidably arranged with respect to rigid guiding elements adapted to guide the elevator cabin such as a ladder, a pair of taut cables or similar.

In these examples, since the pulley system is movably suspended from the travelling cable, in use, the pulley system can self-travel along the travelling cable. Such a motion of the pulley system on the travelling cable straightens the travelling cable at all possible positions. Furthermore, the provision of a lower transverse element having one end attached to the pulley system and the other end slidably arranged with respect to the rigid guiding elements adapted to guide the elevator cabin, together with the motion of the pulley system along the travelling cable entails a slide of the lower transverse element along such rigid guiding elements. Thus, the lower transverse elements act as a spacer between the pulley system and the rigid guiding elements that guide the elevator and as the pulley system is further adapted to be guided by the traction and/or security wire ropes, the lower transverse element substantially stabilizes the traction and/or security wire ropes and the travelling cable position even when loads producing vibrations and sway of the wires are acting. Tangling up of the wires can also thus further be avoided or substantially reduced with the provision of such spacers, i.e. lower transverse elements. The wires are thus subjected to less stress therefore extending their lifetime.

Throughout the present disclosure, pulley is to be understood as covering any form of wheel or roller that guides or redirects a cable or wire rope along its circumference. Pulley herein thus covers e.g. sheaves with a specific groove around its circumference between two flanges, but also any other form of cable guiding wheel.

The elevator systems substantially as hereinbefore described may be adapted or configured for a particular application, such as e.g. a wind turbine tower.

In accordance with another aspect, a wind turbine comprising an elevator system substantially as hereinbefore described arranged within a wind turbine tower is provided.

BRIEF DESCRIPTION OF THE DRAWINGS

Non-limiting examples of the present disclosure will be described in the following, with reference to the appended drawings, in which.

DETAILED DESCRIPTION OF EXAMPLES

Figure 1A:
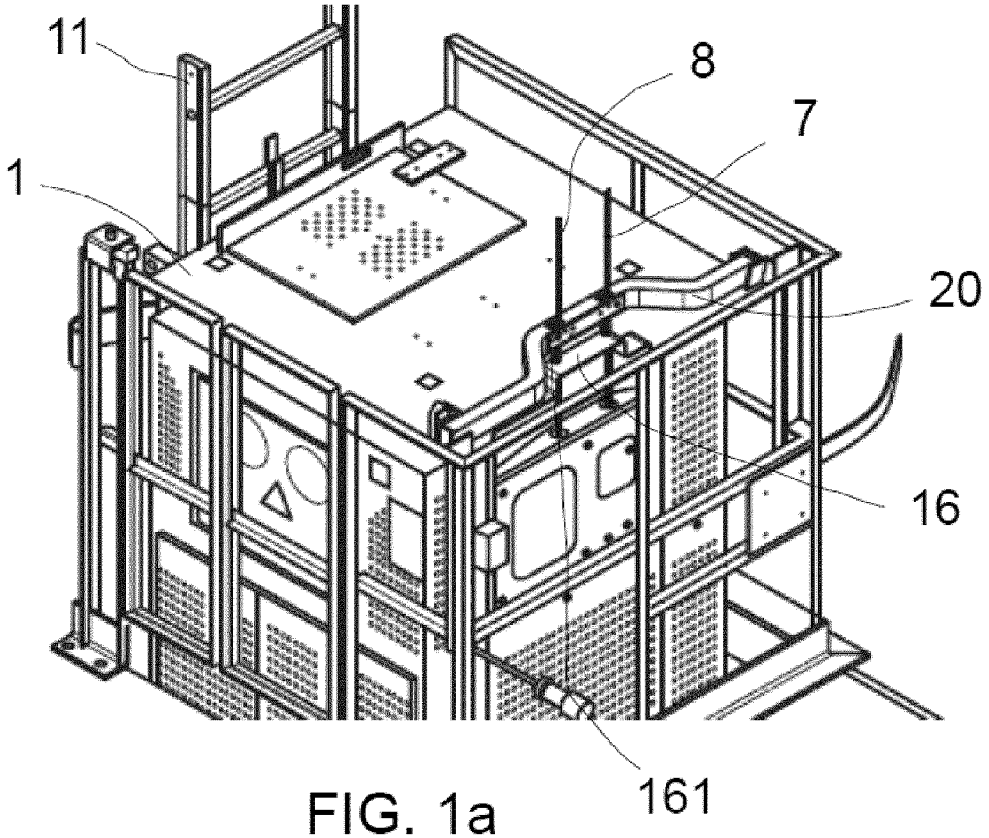
FIGS. 1*a* and 1*b* show perspective partial views of an elevator system.
Figure 1B:
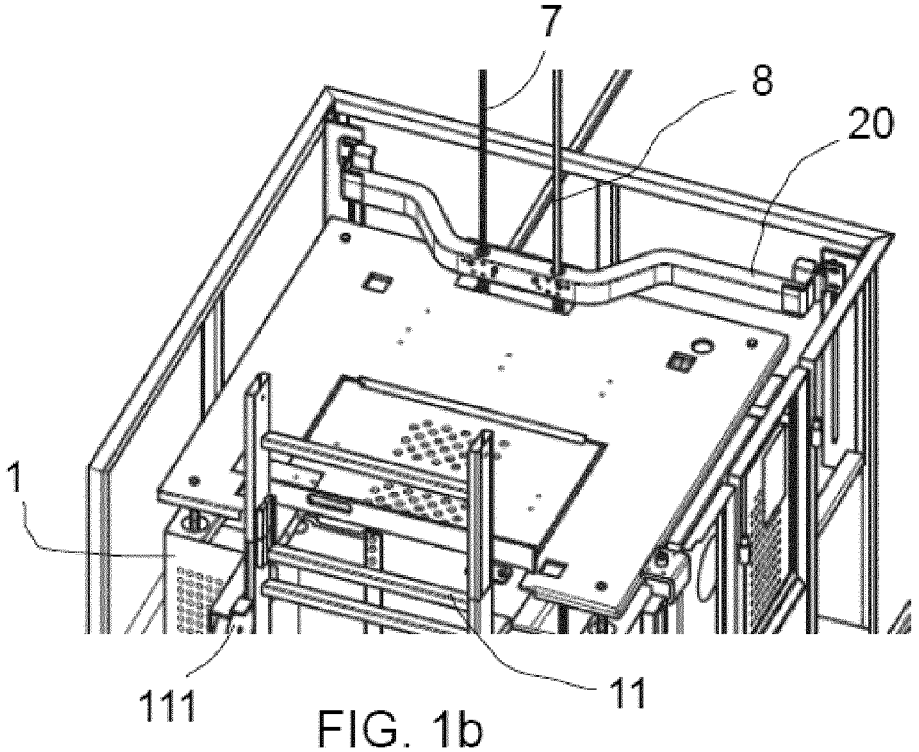

FIGS. 1*a* and 1*b* show partial views of an elevator system according to a first example viewed from the platform and from the ladder respectively. The elevator system may comprise an elevator cabin 1 which may move up and down inside a hoistway (not shown) driven by a traction wire rope 7. A safety wire rope 8 may further be provided. In alternative examples, more than one traction and/or security wire ropes, and even a single traction and/or security wire rope, may be provided.

The elevator cabin 1 may be guided by a ladder 11 arranged on an inner surface of the hoistway (not shown) of the elevator system, for example an inner surface of a wind turbine tower. In this example, at least two pairs of runners 111 (only one visible in FIG. 1*b*) may be provided at the elevator cabin 1 for guiding the cabin 1 on the ladder 11. In other examples, more pairs of runners may be provided at the elevator cabin for guiding the cabin on the ladder.

In alternative examples, the upper transverse bar may further be adapted to be guided by the ladder e.g. by having a suitable shape or support at its ends. These ends may thus be adapted to be slidably mounted with respect to the ladder.

In alternative examples, the elevator cabin may be guided by or around other rigid guiding elements such as a guide rail arranged on the inner surface of the hoistway or a pair of taut cables running e.g. laterally from the elevator cabin. Combinations of these examples may also be foreseen. In these examples, the upper transverse bar may further be guided by the rigid guiding elements adapted to guide the elevator cabin. In that sense its ends may be adapted to be slidably mounted with respect to the rigid guiding elements adapted to guide the elevator cabin.

An upper transverse bar 20 adapted to be guided along the traction wire rope 7 and safety wire rope 8 may be provided above the elevator cabin 1. And the elevator cabin 1 may comprise a further bar 16 mounted at its top and adapted to contact the upper transverse bar 20 from below. The bar 16 of the elevator cabin 1 may further comprise springs 161 or any other resilient element providing damping properties so as to work as a bumper guard for the cabin 1. In alternative examples, instead of a bumper guard provided in the elevator cabin, springs or other resilient elements may be directly provided in a bottom side of the upper transverse bar in order to dampen impacts from the cabin. In further examples, a top part of the cabin and a bottom side of the upper transverse bar may both comprise springs or resilient elements.

An effect of bumper guards or another damping element on the elevator cabin and/or on the upper transverse bar is that an impact with corresponding possible damage may be avoided. Another effect is that since the encounter between elevator cabin and upper transverse bar is softened, it does not trigger an automatic stop of the elevator cabin. Such an automatic stop may take place when a real collision takes place.

Figure 2A:
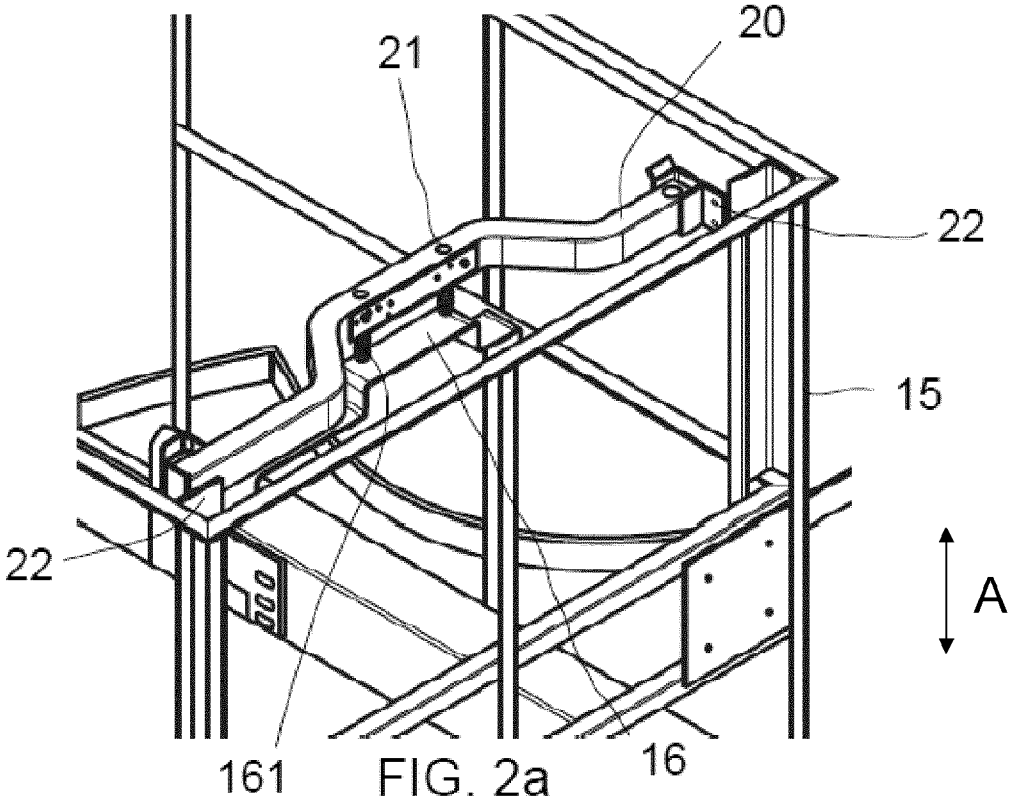
FIGS. 2*a* and 2*b* show perspective views of an upper transverse element.
Figure 2B:
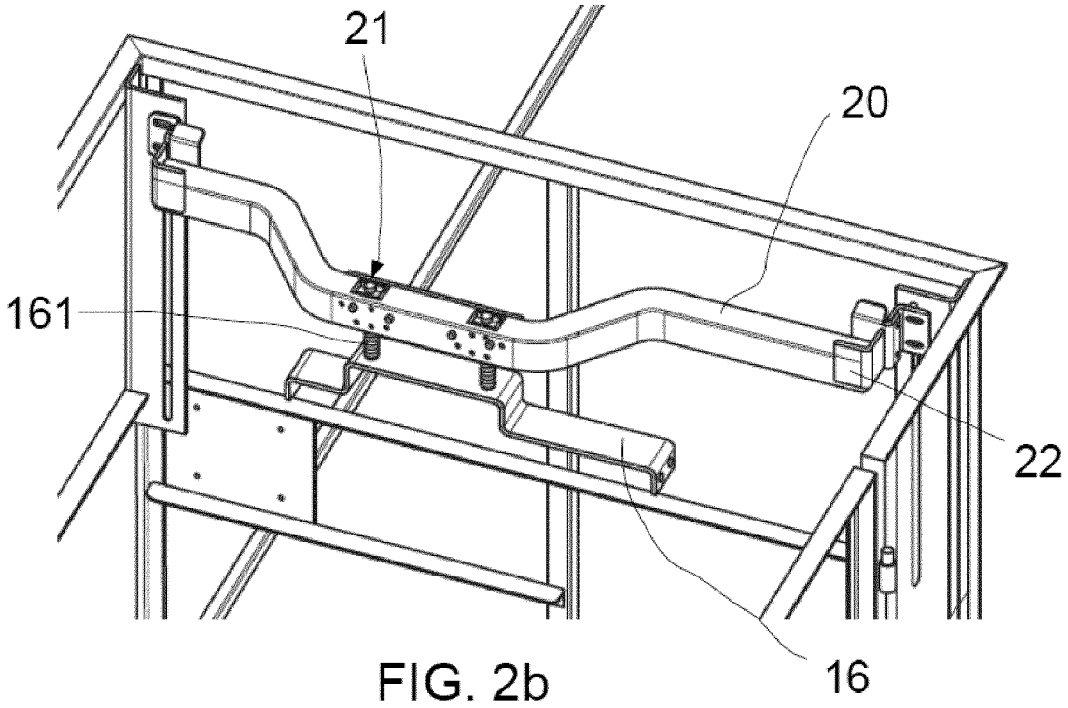

FIGS. 2*a* and 2*b* show perspective views from the platform and from the ladder of the upper transverse bar of the elevator system of FIGS. 1*a* and 1*b*. The cabin as such and the traction and safety wire ropes have been deleted so as to more clearly show the upper transverse bar 20. The upper transverse bar 20 may comprise two orifices 21 adapted to receive the traction and safety wire ropes. The orifices 21 may be provided in the bar 20 in the direction of the up and down movement (arrow A) of the cabin 1. The bar 20 may comprise a central step or may be straight. In alternative examples, the bar may have other shapes such as a rectangular, square, oval or other plate like shape.

In alternative examples, other ways of adapting the upper transverse bar to be guided along the traction and/or safety wire ropes may also be foreseen, e.g. the provision of rollers or runners slidably arranged with respect to the wire ropes and attached to the bar or the provision of eyelets fixed to the bar.

In some examples, the orifices 21 may be provided with pneumatic clamps or similar adapted to close the orifice towards the traction and/or safety wire ropes depending on circumstances, e.g. when the elevator cabin 1 is in standstill.

A pair of brackets 22 may be provided on a platform fence 15 provided along the hoistway. Each bracket 22 may comprise e.g. a lower base and three lateral walls such that the bracket 22 may be adapted to support the upper transverse bar 20 and substantially impede downwards and horizontal movement of the bar 20 and allow upwards movement of the bar 20.

In alternative examples, the brackets may be provided directly in working platforms or in tower flanges provided along the hoistway.

In some examples, the brackets may comprise active parts such as hydraulic or pneumatic clamps so as to close the support once the bar is resting on the brackets lower base. In these cases, the bar can be safely housed within the brackets e.g. when the elevator cabin is at a position below that of the brackets and/or moving downwards. This ensures a correct positioning of the bar in the brackets (support structure) which is desirable especially in high slender structures, such as e.g. tower of larger wind turbines, in which the tower may oscillate significantly. In alternative examples, instead of active parts provided in the brackets (support structure), the active parts may be directly provided in the upper transverse element. In further examples, the support structure and the upper transverse element may both comprise active parts.

In some examples, the upper transverse bar may have a size in at least a direction transverse to elevator cabin up and down movement (arrow A) that is adapted to be larger than that of the elevator cabin in that direction. This may be done by simply providing a larger bar. In further examples, end portions of the upper transverse bar in the direction in which it is adapted to be larger than the elevator cabin may comprise extensions. In still further examples, the end portions may be foldable, removable or retractable. Furthermore the brackets may protrude from the inner hoistway surface a distance such that movement of the cabin in between two brackets of the pair is allowed. This way, when the elevator cabin is moving upwards and reaches e.g. the upper transverse bar it can push the bar and continue its upwards career and when the cabin is moving downwards and reaches the height at which the brackets are mounted, the bar can rest in the brackets and the cabin can continue its downwards career. This means that the brackets are dimensioned such that they do not interfere with elevator cabin up and down movement.

Figure 3B:
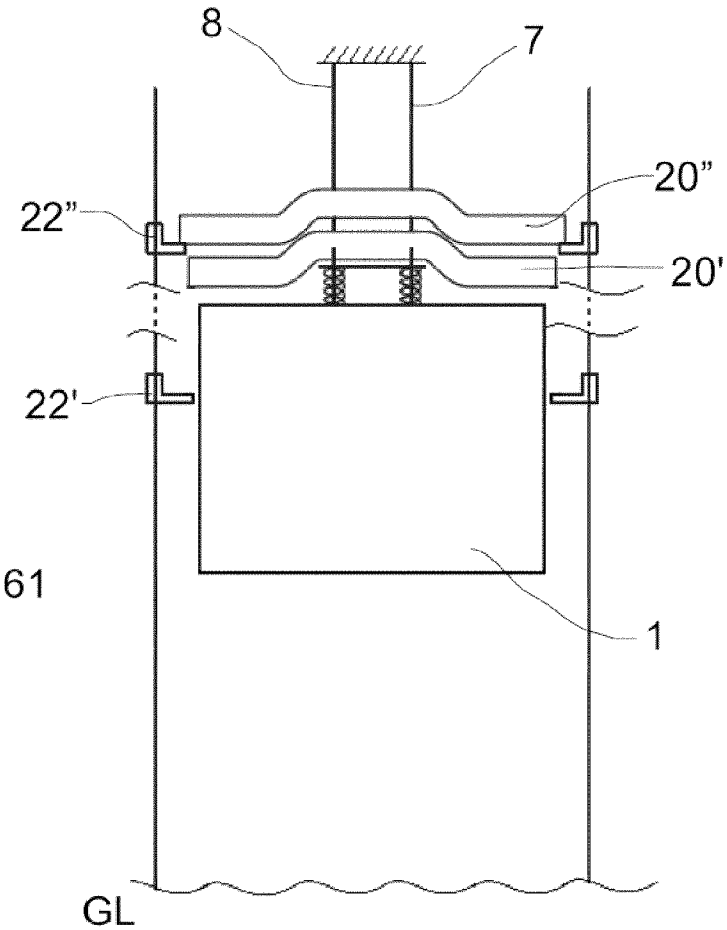
FIGS. 3*a* and 3*b* schematically show a side view of an elevator system in two positions of the elevator cabin.
Figure 3A:
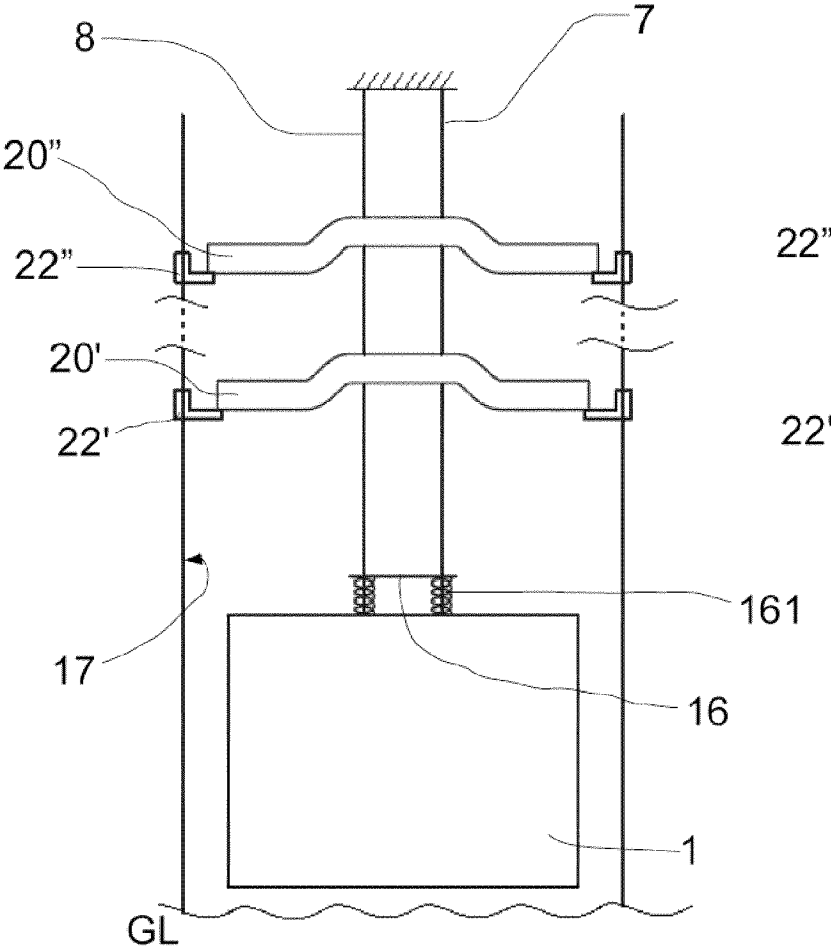

FIGS. 3*a* and 3*b* schematically show a side view of an elevator system according to another example in two positions of the elevator cabin. FIG. 3*a* shows a first position in which elevator cabin 1 may be at or near ground level GL. FIG. 3*b* shows a second position in which the elevator cabin 1 may be at or near its uppermost position.

In the example of FIGS. 3*a* and 3*b* two upper transverse bars 20' and 20" may be provided. Respectively two pairs of brackets 22' and 22" may also be provided along the hoistway for supporting each upper transverse bar 20' and 20". In this example, the pairs of brackets 22' and 22" may be mounted directly to the inner hoistway at different heights within the hoistway along the up and down direction. In other examples, the brackets may be provided at working platforms, platform fences or tower flanges provided along the hoistway.

In some examples, the position of each pair of brackets may be such that each pair of brackets 22' and 22" coincides e.g. with a working platform. In others, the position of each pair of brackets is such that when the elevator cabin is in a position closer to the ground level GL the bars 20' and 20" supported by the brackets 22' and 22" act as spacers for the traction 7 and safety 8 wire ropes along the height of the hoistway. The height along the hoistway at which each pair of brackets may be provided may depend on the total height of the hoistway and e.g. the inclination of its inner wall.

In the example of FIGS. 3*a* and 3*b*, the bar provided closer to the elevator cabin 1, i.e. bar 20', may be shorter than the other bar, i.e. bar 20". Furthermore, the pair of brackets 22" for supporting bar 20" may protrude from the inner hoistway surface 17 a distance such that movement of bar 20' (provided closer to ground level GL) in between the pair of brackets 22" (provided farther away from ground level GL) is allowed. This way, when the cabin is moving upwards and reaches the height of e.g. brackets 22', it can push bar 20' and drag it with it while continuing with the upwards movement.

In further examples, more upper transverse elements, each with a respective support structure provided along the hoistway, may be provided. Support structures may be provided anywhere in the path of the elevator cabin, and in particular somewhere in the upper half of the path. Each upper transverse element and each bracket may be made substantially as hereinbefore described. When more than one upper transverse elements are provided, the size of the elements may increase from the transverse element provided closer to ground level GL as explained above in connection with FIGS. 3*a* and 3*b*.

Figure 4A:
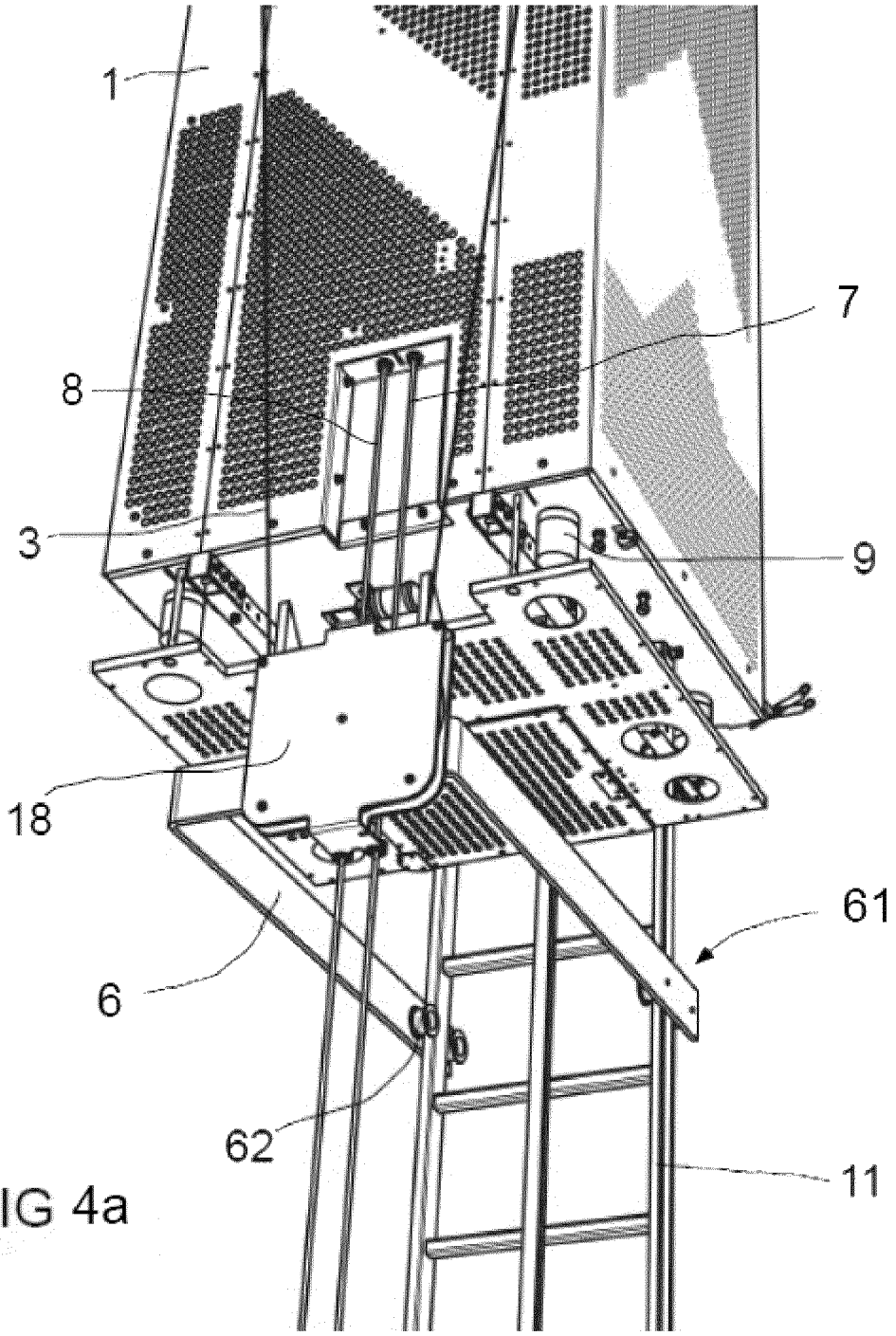
FIGS. 4*a* and 4*b* show perspective partial views of an elevator system.
Figure 4B:
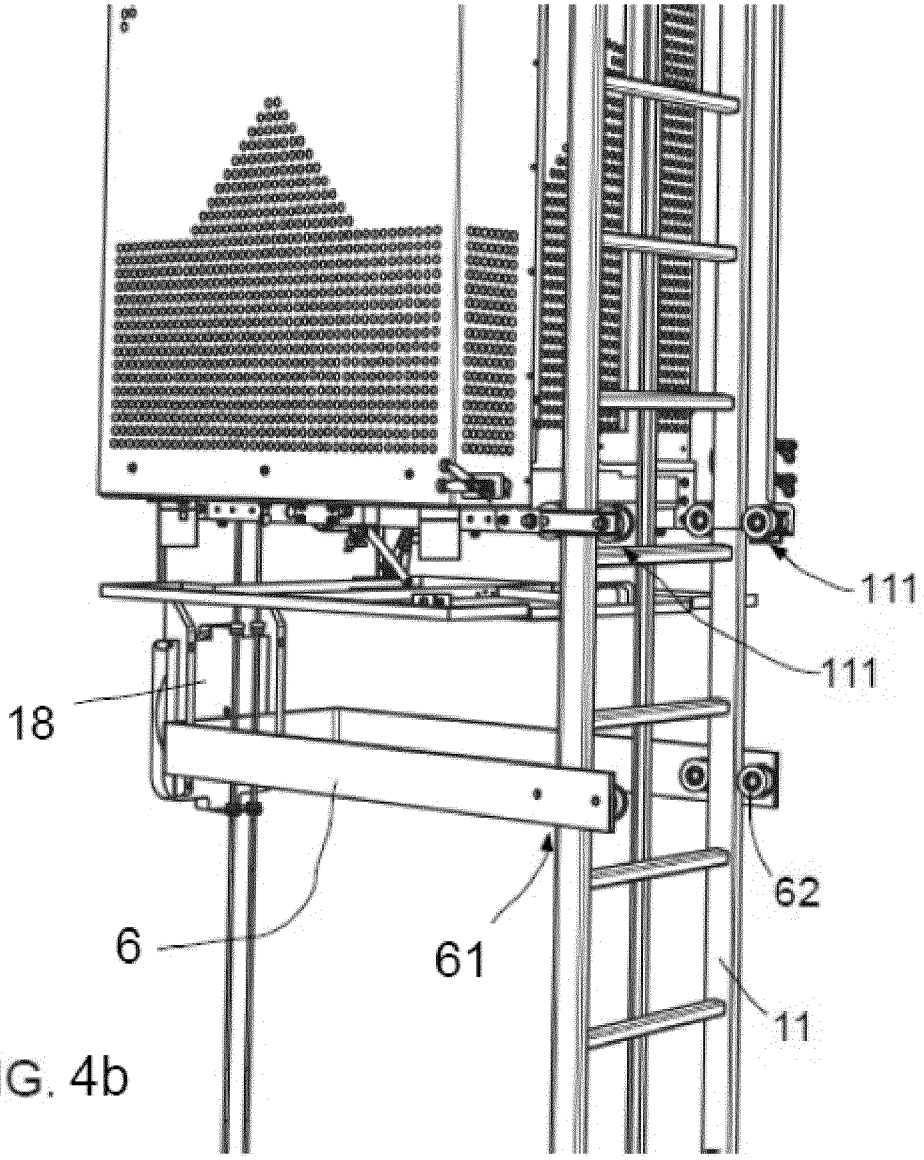

FIGS. 4*a* and 4*b* show two partial perspective views of an elevator system according to a further example. FIG. 4*a* shows that a travelling cable 3 may be provided for supplying energy to the elevator cabin 1. The travelling cable 3 may be connected to a power supply at one end (not shown) and to the elevator cabin 1 at the other end. A pulley system 18 may be arranged in a movably suspended manner on the travelling cable 3. One end of the travelling cable arrangement may be mounted at some point along the hoistway. In case of an elevator system for a wind turbine it may be attached at the tower. The other end of the travelling cable arrangement may be connected to the elevator cabin. The height at which the travelling cable arrangement is mounted may be at approximately half the total height of the hoistway, or at approximately half the total height of the tower. The power supply may be provided at any height in the hoistway (see FIG. 6*b*).

In the example of FIGS. 4*a* and 4*b*, the pulley system 5 may further be guided along the traction 7 and safety 8 wire ropes of the elevator system. In other cases, the pulley system may be adapted to be guided along a single traction or safety wire ropes. More traction and/or safety wire ropes may also be foreseen.

Two lower transverse arms 6 may each extend laterally from the pulley system 18. Each lower transverse arm 6 may extend substantially perpendicular to an up and down movement of the elevator cabin 1. Each lower transverse arm 6 may comprise free ends 61 comprising each a pair of wheels or runners 62 for slidably arranging the pulley system 18 with respect to the ladder 11. In alternative examples only one transverse arm may be provided. An aspect of using a single transverse arm is that it may be less costly. FIGS. 5*a*-5*d* show the free ends of the transverse arms according to some different examples. In further examples more pairs of runners may be provided at the elevator cabin for guiding the cabin on the ladder. The transverse arms help to reduce oscillations and movements of the traction and safety wire ropes while reducing movements and oscillations of the travelling cable.

In some examples, the transverse arms may be made with the pulley system as an integral piece or they may be welded to the pulley system. In other cases, they may be fixed to the pulley system by e.g. screws or bolts.

The elevator cabin 1 may further be provided with feet 9 made for example of rubber, providing a distance between a bottom portion of the elevator cabin and a bottom platform floor when the elevator cabin reaches the bottom platform floor.

FIGS. 5*a*-5*d* show the pulley system with lower transverse elements according to different examples.

Figure 5A:
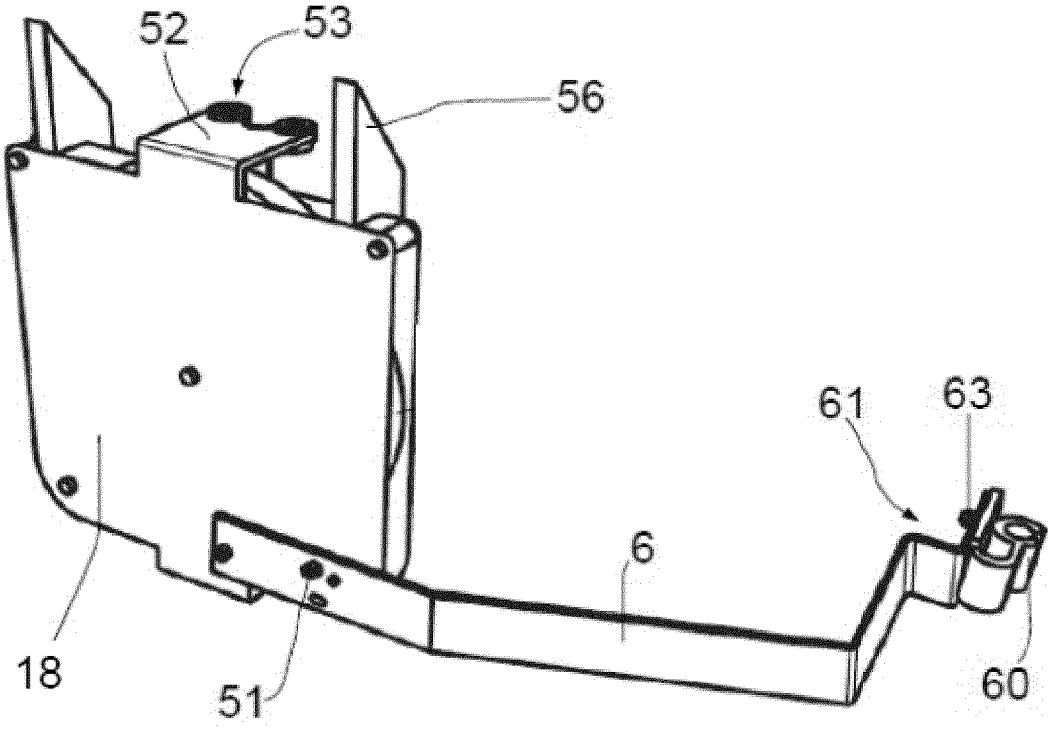
FIGS. 5*a*-5*d* show different examples of pulley systems with lower transverse elements.

FIG. 5*a* shows an example in which only one transverse arm 6 is fixed to the pulley system 18 by screws 51. The transverse arm 6 may comprise a free end 61 having a substantially C-shaped guide 60 that may be fixed to the arm by a screw or bolt 63. Other shapes or supports may also be foreseen for the free ends of the transverse arm as long as they may be adapted to be slidably mounted with respect to taut cables or a ladder depending on circumstances.

The pulley system 18 may further comprise at least one flange 52 having two holes 53 for guiding traction and/or safety wire ropes of the elevator system. In alternative embodiments other number of holes may be provided. In some cases the flange 52 may be integrally formed with the pulley system 18. In others, it may be welded or it may be fixed with screws. FIG. 5*a* shows an example in which top and lower flanges 52 may be integrally formed with the pulley system 18. Each flange 52 may comprise two holes 53.

Figure 5B:
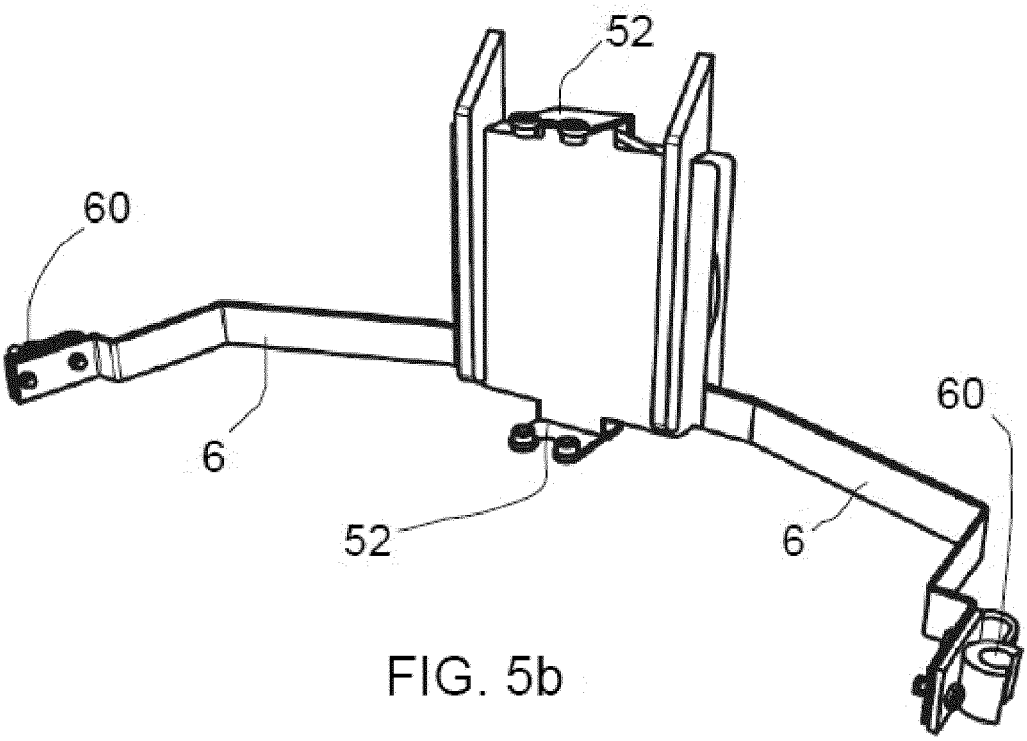

FIG. 5*b* differs from FIG. 5*a* in that two transverse arms 6 are provided. The rest is substantially similar to FIG. 5*a*. In FIG. 5*b* the two flanges 52 (upper and lower) are clearly visible.

Figure 5C:
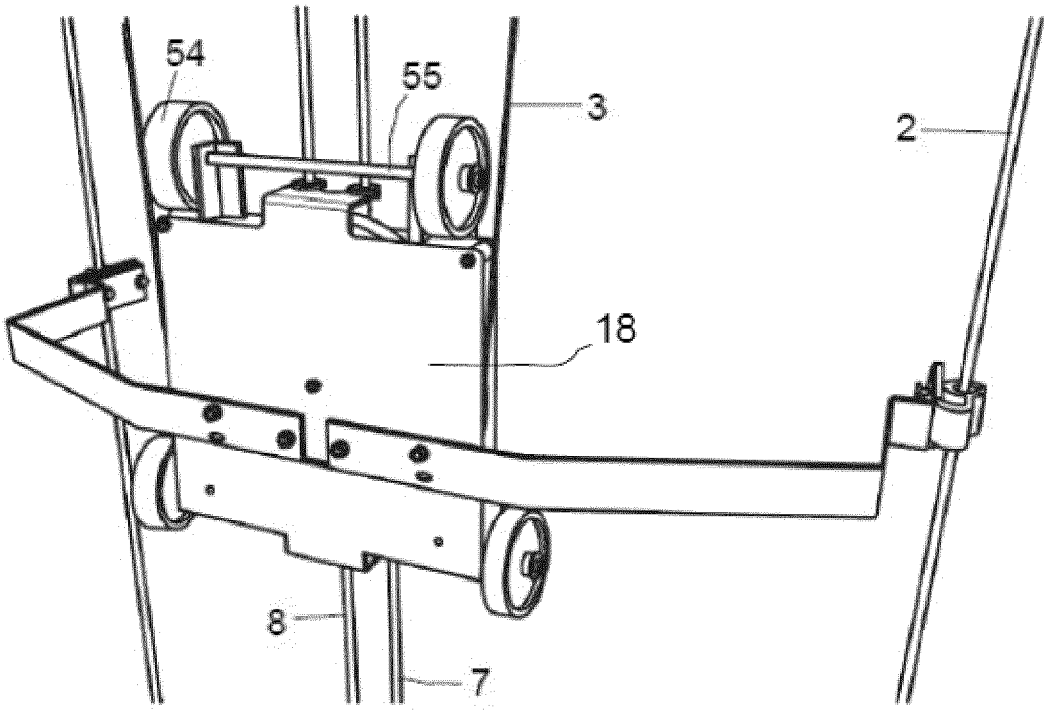

FIG. 5*c* differs from FIG. 5*b* in that the pulley system further comprises runners that can glide or ride over the inner surface of the hoistway. In this example, four wheels 54 arranged in pairs (upper and lower pair of wheels) through a shaft 55 may be provided. The wheels may help overcome any bumps or protrusions of the inner surface of the hoistway of the elevator system, e.g. the junctions between tower sections for the inner surface of a wind turbine tower wall.

Figure 5D:
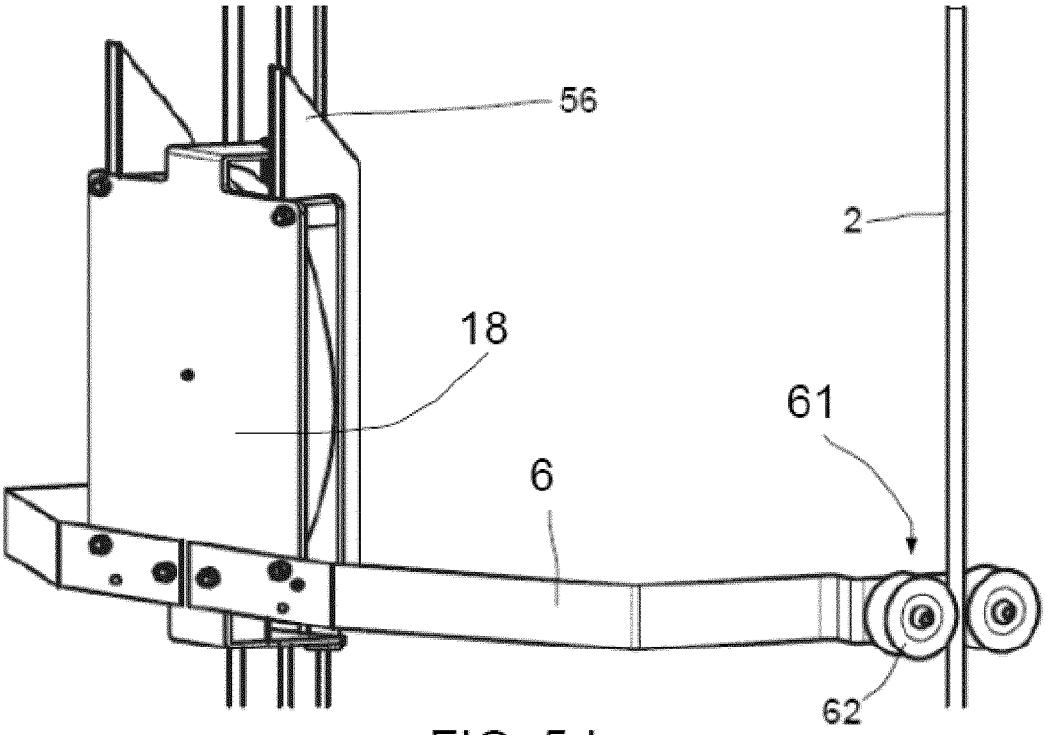

FIG. 5*d* differ from FIGS. 5*b* and 5*c* in that each free end 61 of the transverse elements 6 comprises a pair of runners 62 arranged to slide along taut cables 2 or the ladder (see FIGS. 4*a* and 4*b*). In this example, as well as in the examples of FIGS. 5*a* and 5*b*, the pulley system further comprises wedge shaped guiding elements 56. As the pulley system 18 moves upwards and encounters e.g. a flange of a junction between two tower sections, the wedge shaped elements can help the pulley system 18 to slide over such a junction. Similar wedge shaped guiding elements may be provided at the bottom of the pulley frame for the same reasons. These wedge shaped guiding elements thus act as runners gliding along an inner surface of e.g. a wind turbine tower.

Figure 6B:
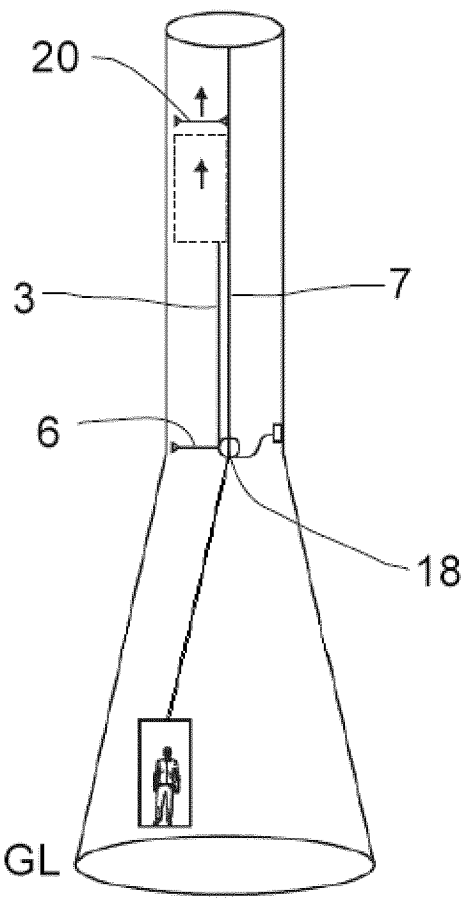
FIGS. 6*a* and 6*b* schematically show an elevator system arranged in a slender tower in two positions of the elevator cabin.
Figure 6A:
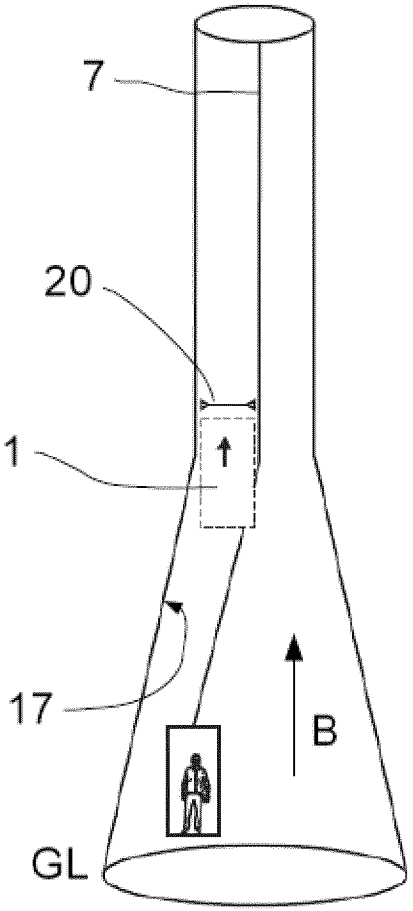

FIGS. 6*a* and 6*b* schematically show side views of an elevator system arranged in a slender tower such as a wind turbine tower in various positions of the elevator cabin within the hoistway.

FIG. 6*a* shows an initial position in which the elevator cabin 1 is first in a ground level GL position. After an upwards career (see arrow B) elevator cabin (shown in broken lines) may be about to reach an upper transverse element 20 substantially as hereinbefore described. The upper transverse element 20 may be resting on brackets (not shown) substantially as hereinbefore described. This figure clearly shows the upper transverse element 20 acting e.g. as a spacer for the traction wire rope 7 such that the wire rather than describing a straight line from the point from which it hangs to the elevator cabin at ground level GL, passes through the upper transverse element 20 thus maintaining a distance to the inner surface 17 of the hoistway even when an abrupt change in the taper shape of the hoistway is present.

FIG. 6*b* shows a final position in which the elevator cabin 1 (shown in broken lines) may be at its uppermost position. The upper transverse element 20 may also be at this uppermost position. This is possible because, as explained above in connection with FIGS. 3*a* and 3*b* the elevator cabin 1 pushes the upper transverse element 20 from below in its upwards career and the elevator cabin 1 is able to pass in between the brackets adapted to support the upper transverse element. In FIG. 6*b* the travelling cable 3 and the pulley system 18 described in connection with FIGS. 4*a* and 4*b* have also been depicted. And a lower transverse bar 6 substantially as hereinbefore described may also be provided with one end attached to the pulley system 18 and the other end adapted to be slidably arranged with respect to the rigid guiding elements adapted to guide the elevator cabin 1. This figure clearly shows that in this position of the elevator cabin 1, the lower transverse bar 6 acts as a spacer for the traction wire rope 7 such that the wire rather than describing a straight line from the point from which it hangs to seek for their point straight down, runs through the lower transverse element 6 thus maintaining a distance to the inner surface 17 of the hoistway even when an abrupt change in the taper shape of the hoistway is present.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A wind turbine comprising:

a wind turbine tower;

a plurality of working platforms fixed at different heights along the wind turbine tower and configured to allow workers to perform maintenance; and an elevator system arranged within the wind turbine tower, the elevator system comprising:

an elevator cabin;

an upper transverse element provided above the elevator cabin and adapted to be guided along a traction wire rope and/or a safety wire rope; and a support structure, which is adapted to support the upper transverse element and substantially impede its movement in a downwards direction and in a horizontal direction, and to allow movement of the upper transverse element in an upwards direction, wherein the support structure is arranged with one of the working platforms; wherein one or more of the working platforms comprise a platform fence, and wherein the support structure is arranged with or formed by the platform fence.

2. The wind turbine according to claim 1, wherein the support structure comprises a pair of brackets, the brackets being dimensioned such that they do not interfere with an elevator cabin movement.

3. The wind turbine according to claim 1, where the support structure comprises a pair of brackets provided on the platform fence.

4. The wind turbine according to claim 1, wherein the upper transverse element has a size in at least a direction transversal to elevator cabin up and down movement that is adapted to be larger than that of the elevator cabin in that direction.

5. The wind turbine according to claim 1, wherein the elevator cabin comprises a buffer element arranged on top of the elevator cabin, the buffer element being adapted to contact the upper transverse element.

6. The wind turbine according to claim 5, wherein the buffer element is provided with springs or any other resilient element.

7. The wind turbine according to claim 1, wherein the upper transverse element comprises an orifice in a direction of up and down movement of the elevator cabin, the orifice being adapted to receive the traction wire rope and/or the safety wire rope.

8. The wind turbine according to claim 1, wherein the elevator system comprises the safety wire rope and the traction wire rope and the upper transverse element is adapted to be guided along the safety wire rope and the traction wire rope.

9. The wind turbine according to claim 1, wherein the elevator cabin is guided by a pair of taut cables running laterally from the elevator cabin or by a ladder arranged on an inner surface of an elevator system hoistway.

10. The wind turbine according to claim 9, wherein the upper transverse element is further guided by the pair of taut cables running laterally from the elevator cabin or by the ladder arranged on an inner surface of the hoistway.

11. The wind turbine according to claim 1, wherein the elevator cabin is guided by a ladder arranged on an inner surface of the wind turbine tower.

12. The wind turbine according to claim 11, wherein the upper transverse element is further guided by the ladder arranged on an inner surface of the hoistway.

* * * * *